US009267679B2

(12) United States Patent
Takafuji et al.

(10) Patent No.: US 9,267,679 B2
(45) Date of Patent: Feb. 23, 2016

(54) RISER TOP STRUCTURE FOR CIRCULATING FLUIDIZED BED GASIFICATION FURNACE

(75) Inventors: Makoto Takafuji, Koto-ku (JP); Toshiyuki Suda, Koto-ku (JP)

(73) Assignee: IHI Corporation, Tokyo (JP)

( * ) Notice: Subject to any disclaimer, the term of this patent is extended or adjusted under 35 U.S.C. 154(b) by 1109 days.

(21) Appl. No.: 12/996,519

(22) PCT Filed: Jun. 16, 2009

(86) PCT No.: PCT/JP2009/002718

§ 371 (c)(1),
(2), (4) Date: Dec. 6, 2010

(87) PCT Pub. No.: WO2009/157151

PCT Pub. Date: Dec. 30, 2009

(65) Prior Publication Data

US 2011/0073021 A1 Mar. 31, 2011

(30) Foreign Application Priority Data

Jun. 23, 2008 (JP) ..... 2008-162825

(51) Int. Cl.

| | |
|---|---|
| ***F23G 5/00*** | (2006.01) |
| ***F23C 10/32*** | (2006.01) |
| ***F23C 10/04*** | (2006.01) |
| ***F23C 10/10*** | (2006.01) |
| ***F23C 10/18*** | (2006.01) |
| ***C10J 3/46*** | (2006.01) |

(52) U.S. Cl.

CPC ..... *F23C 10/32* (2013.01); *C10J 3/463* (2013.01); *F23C 10/04* (2013.01); *F23C 10/10* (2013.01); *F23C 10/18* (2013.01); *C10J 2300/0993* (2013.01); *C10J 2300/1637* (2013.01); *C10J 2300/1807* (2013.01); *F23C 2206/102* (2013.01)

(58) Field of Classification Search

CPC ..... F23C 10/04; F23C 10/10; F23C 10/18; F23C 10/32; F23C 10/20; F23C 10/005; F23C 2206/102; C10J 3/463; C10J 3/54; C10J 2300/1807; C10J 2300/0993; C10J 2300/1637; C10J 3/12; F23G 5/30; F23G 5/027; F23G 2201/40; F23G 5/12; B01D 50/00; B01D 45/16; B04C 5/13; B04C 1/00; F23J 15/027; C10B 49/22; Y02E 50/14

USPC ..... 110/245, 216, 229; 122/4 D; 432/58; 422/145, 139

See application file for complete search history.

(56) References Cited

U.S. PATENT DOCUMENTS

| | | | | |
|---|---|---|---|---|
| 4,568,362 | A * | 2/1986 | Deglise et al. | 48/209 |
| 4,993,323 | A * | 2/1991 | Tabery et al. | 110/346 |
| 5,355,725 | A * | 10/1994 | Dietz | 73/198 |
| 2008/0271335 | A1 * | 11/2008 | Kimball | 34/79 |

FOREIGN PATENT DOCUMENTS

| | | |
|---|---|---|
| DE | 3214649 A1 | 12/1982 |
| JP | 2000 46311 | 2/2000 |

(Continued)

OTHER PUBLICATIONS

International Search Report issued Jul. 14, 2009 in PCT/JP09/002718 filed Jun. 16, 2009.

*Primary Examiner* — Kenneth Rinehart
*Assistant Examiner* — Bao D Nguyen
(74) *Attorney, Agent, or Firm* — Oblon, McClelland, Maier & Neustadt, L.L.P.

(57) ABSTRACT

A lateral duct 15 for interconnecting a riser 1 and a cyclone separator 2 has an introduction portion 16 at the connection with the riser 1 which has a cross-sectional area equal to that of the riser 1, and a throttled portion 17 between the introduction portion 16 and the cyclone separator 2 which has cross-sectional areas gradually reduced from the introduction portion 16 to the cyclone separator 2 so as to increase a flow velocity of combustion gas.

3 Claims, 4 Drawing Sheets

(56) References Cited

FOREIGN PATENT DOCUMENTS

| | | |
|---|---|---|
| JP | 2000 210595 | 8/2000 |
| JP | 2001 65844 | 3/2001 |
| JP | 2002 265960 | 9/2002 |
| JP | 2004 132621 | 4/2004 |
| JP | 2005 041959 | 2/2005 |
| JP | 2006 292275 | 10/2006 |

* cited by examiner

RISER TOP STRUCTURE FOR CIRCULATING FLUIDIZED BED GASIFICATION FURNACE

TECHNICAL FIELD

The present invention relates to a riser top structure for a circulating fluidized bed gasification furnace which can increase in a simple construction an amount of circulation medium taken out from a riser to thereby increase a circulated amount of circulation medium.

BACKGROUND ART

There is a conventional circulating fluidized bed furnace wherein circulation medium is heated by combustion in a riser (a fluidized combustion furnace) and combustion gas blown up is laterally introduced through a lateral duct into a cyclone separator for capture of the circulation medium, the captured circulation medium being guided to and stored in a storage. The stored circulation medium is fluidized for circulation into the riser (see Patent Literature 1).

In Patent Literature 1, the fluidization of the circulation medium stored in the storage is controlled to control a flow rate of the circulation medium to be circulated to the riser. In Patent Literature 1, the amount of the circulation medium taken out from the riser and supplied to the storage is controlled, for example, by regulating a superficial velocity in the riser through control of the supply of air to the riser.

Meanwhile, nowadays, there is a circulating fluidized bed gasification furnace wherein circulation medium is heated in a riser and the heated circulation medium is captured in a cyclone separator. The captured circulation medium is guided to the fluidized bed gasification furnace where heat possessed by the guided circulation medium is utilized for a gasification reaction (endothermic reaction) of a raw material. The circulation medium lowered in temperature due to the gasification and ungasified unreacted char are circulated to the riser where the char is burned to heat the circulation medium (see Patent Literature 2).

FIGS. 1 and 2 are schematic views showing an example of the above-mentioned circulating fluidized bed gasification furnace. Reference numeral 1 denotes a riser to which air 12 is supplied for combustion; 2, a cyclone separator to which combustion gas 4 taken out through a top of the riser 1 via a lateral duct 3 is guided, circulation medium admixed in the combustion gas 4 being captured while exhaust gas 6 is discharged; 7, a fluidized bed gasification furnace to which the circulation medium 5 captured by the separator 2 and raw material 8 such as coal are guided and to which a gasifying agent 9 such as steam or air is introduced from below, heat of the circulation medium 5 being utilized for gasification of the raw material 8 to produce gasification gas 10; 11, a circulation passage for returning the circulation medium and ungasified unreacted char in the fluidized bed gasification furnace 7 to the riser 1 where the char supplied through the passage 11 is burned to heat the circulation medium. In FIG. 1, reference numeral 13 designates auxiliary fuel.

In the circulating fluidized bed gasification furnace shown in FIGS. 1 and 2, plenty of heat must be supplied by the riser 1 for the gasification reaction in the fluidized bed gasification furnace 7. To this end, a supply of the circulation medium 5 from the riser 1 to the fluidized bed gasification furnace 7, i.e., an amount of the circulation medium 5 taken out from the riser 1 is required to be increased to balance heat budget in the riser 1 and gasification furnace 7 to thereby enable gasification.

Thus, it is conceivable also in the apparatus shown in FIGS. 1 and 2 that, just like Patent Literature 1, the supply of air 12 to the riser 1 is increased to enhance superficial velocity in the riser 1 to thereby increase the supply of the circulation medium 5 from the riser 1 to the fluidized bed gasification furnace 7.

However, a given reaction time is required for combustion of char in the riser 1; mere enhancement of the superficial velocity in the riser 1 by increase of the air amount would bring about deteriorated combustion quality, possibly resulting in the insufficiently heated circulation medium. Thus, even if the supply of air 12 to the riser 1 is controlled to obtain an utmost superficial velocity which ensures sufficient combustion quality, increase in supply of the circulation medium from the riser 1 to the fluidized bed gasification furnace 7 is limited. Specifically, as shown in FIGS. 1 and 2, in order to increase a flow velocity of the combustion gas 4 tangentially supplied to the cyclone separator 2 for separation of the circulation medium 5, the lateral duct 3 interconnecting the riser 1 and the cyclone separator 2 must have a reduced cross-sectional area and thus has a cross-sectional area smaller than that of the riser 1.

As a result, the circulation medium blown up to an upper end of the riser 1 has difficulty in orientation to the lateral duct 3, and may drop in the riser 1 by itself or through collision against a top wall of the riser 1, failing to increase a circulated amount of the circulation medium from the riser 1 to the fluidized bed gasification furnace 7. Such failure of the increased circulation medium 5 from the riser 1 to the fluidized bed gasification furnace 7 may result in lack of heat necessary for gasification of the raw material 8 in the fluidized bed gasification furnace 7. In order to overcome this, the auxiliary fuel 13 must be supplied to the riser 1 to enhance a heating temperature of the circulation medium; alternatively, the riser 1 must be increased in size to increase the circulated amount of the circulation medium 5 through increase of a total amount of the circulation medium. As a result, disadvantageously, running or equipment cost will increase.

In order to overcome such problem, there has been proposed an apparatus wherein at least a reduced-diameter intermediate cylinder is arranged on a top of a riser to increase a flow velocity of combustion gas in the riser to thereby increase an amount of the circulation medium discharged to a cyclone separator (see Patent Literature 3).

CITATION LIST

Patent Literature

Patent Literature 1: JP 2004-132621A
Patent Literature 2: JP 2005-041959A
Patent Literature 3: JP 2002-265960A

SUMMARY OF INVENTION

Technical Problems

However, in the apparatus shown in Patent Literature 3, the riser has diameters reduced in plural steps and therefore is complicated in structure and moreover the riser is internally lined with a refractory. Thus, setup of the riser complicated in structure and lined with the refractory is extremely troublesome and costly. When the flow velocity is increased by reduction in diameter of the riser in plural steps as mentioned in the above, the combustion gas including the high-temperature circulation medium is fluidized at high velocity through the intermediate cylinder and a possible smaller-diameter portion thereon, disadvantageously resulting in increased wear rate of the refractory on the riser.

The invention was made in view of the above and has its object to provide a riser top structure for a circulating fluidized bed gasification furnace which can increase in a simple construction an amount of circulation medium taken out from a riser to thereby increase a circulated amount of the circulation medium.

Solution to Problems

The invention is directed to a riser top structure for a circulating fluidized bed gasification furnace comprising a riser for heating circulation medium by combustion of air supplied from below, a cyclone separator to which combustion gas taken out through a top of the riser via a lateral duct is guided for capture of the circulation medium admixed in said combustion gas, a fluidized bed gasification furnace to which the circulation medium captured by the cyclone separator and raw material as well as a gasifying agent are guided for gasification of the raw material to produce gasification gas, a circulation passage for returning the circulation medium in the fluidized bed gasification furnace and ungasified unreacted char to said riser, characterized in that said lateral duct comprises an introduction portion at connection with the riser having a cross-sectional area equal to that of the riser and a throttled portion between said introduction portion and said cyclone separator having a cross-sectional area gradually reduced from said introduction portion to said cyclone separator to enhance a flow velocity of the combustion gas.

In the riser top structure for the circulating fluidized bed gasification furnace, it is preferable that an upper end of the riser is formed with a curved portion connected to the introduction portion of said lateral duct.

In the riser top structure for the circulating fluidized bed gasification furnace, it is preferable that an upper end of the riser has a slant wall at a position away from the connection with the introduction portion of said lateral duct, said slant wall being provided by a closed cutout at 45' angle.

Advantageous Effects of Invention

According to a riser top structure for a circulating fluidized bed gasification furnace of the invention, a lateral duct for interconnecting a riser top and a cyclone separator comprises an introduction portion at connection with the riser having a cross-sectional area equal to that of the riser and a throttled portion between the introduction portion and the cyclone separator having a cross-sectional area gradually reduced from the introduction portion to the cyclone separator to enhance a flow velocity of the combustion gas, so that the circulation medium blown up to an upper end of the riser is smoothly guided into the introduction portion of the lateral duct having the cross-sectional area equal to that of the riser. The circulation medium once introduced into the introduction portion is guided to the cyclone separator without dropping into the riser, with an advantageous effect that an amount of the circulation medium circulated to the fluidized bed gasification furnace is substantially increased. The combustion gas introduced into the introduction portion is enhanced in flow velocity by the throttled portion, with an advantageous result that the circulation medium is favorably captured by the cyclone separator.

DESCRIPTION OF EMBODIMENTS

Embodiments of the invention will be described in conjunction with the attached drawings.

Figure 1:
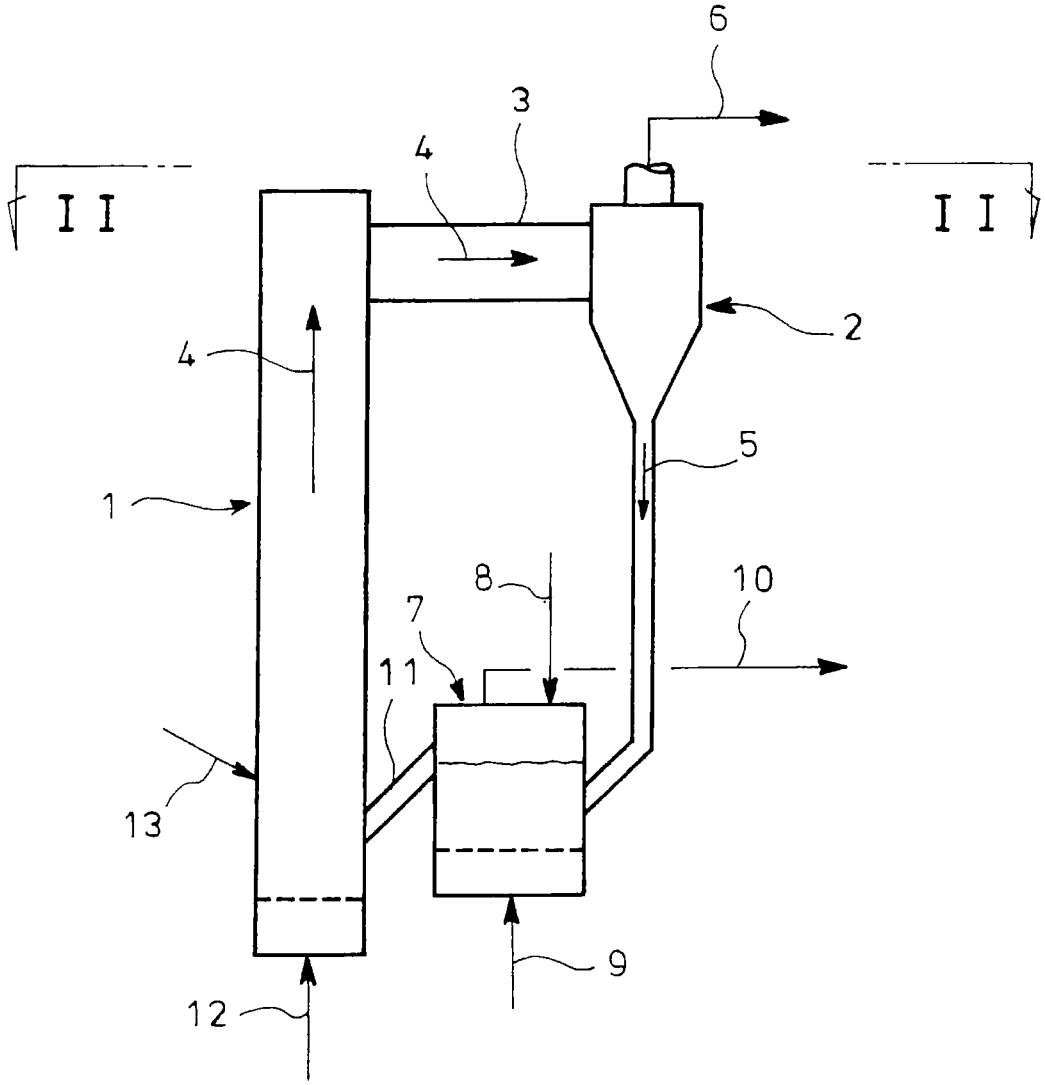
FIG. 1 is a schematic front view showing a conventional circulating fluidized bed gasification furnace.
Figure 2:
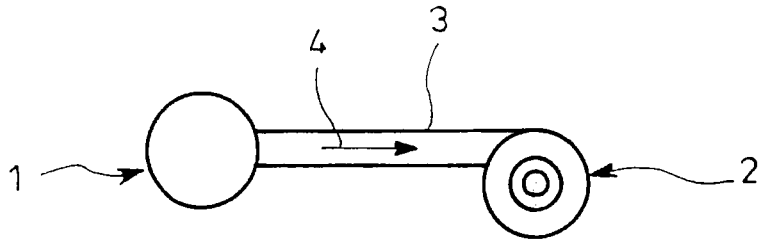
FIG. 2 is a plan view looking in a direction of arrows II in FIG. 1.
Figure 3:
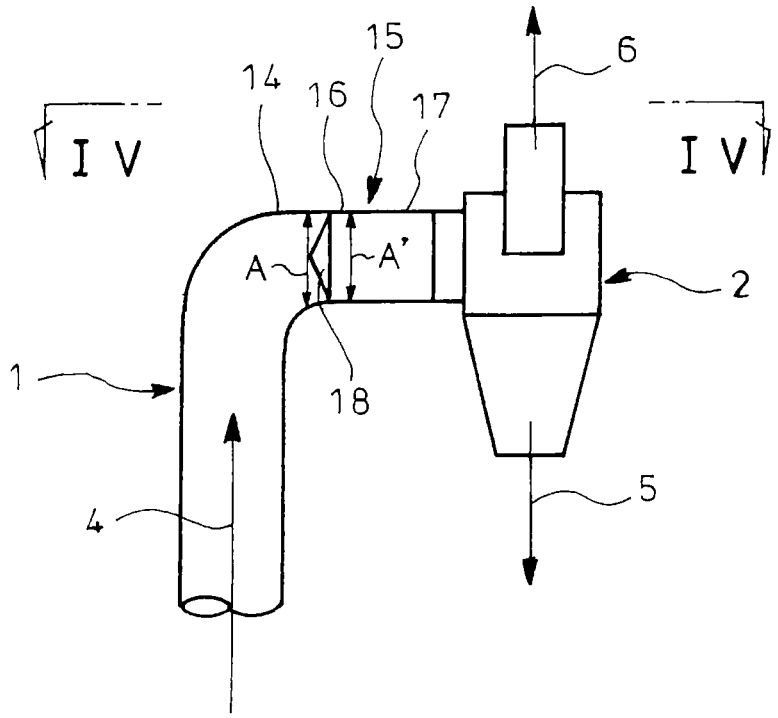
FIG. 3 is a front view showing an embodiment of the invention.
Figure 4:
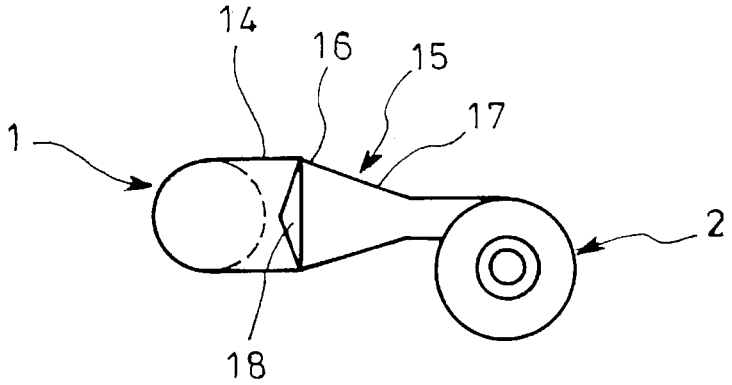
FIG. 4 is a plan view looking in a direction of arrows IV in FIG. 3.

FIG. 3 is a front view showing an embodiment of the invention applied to a riser top for a circulating fluidized bed gasification furnace shown in FIGS. 1 and 2, and FIG. 4 is a plan view looking in the direction of arrows IV in FIG. 3. In FIGS. 3 and 4, parts similar to those in FIGS. 1 and 2 are represented by the same reference numerals. As shown in FIGS. 3 and 4, an upper end of a cylindrical riser 1 is formed with a curved portion 14 which has a cross-sectional area equal to that of the riser 1 and which is bent laterally to a cyclone separator 2, an end of the curved portion 14 being connected to the cyclone separator 2 through a lateral duct 15 having varied cross section.

The lateral duct 15 comprises an introduction portion 16 which has a cross-sectional area A' equal to a cross-sectional area A of the curved portion 14 and which is connected in rectangular cross section to an end of the curved portion 14, and a throttled portion 17 connected in rectangular cross section to the cyclone separator 2 with its cross-sectional area being gradually reduced in a direction from the introduction portion 16 to the cyclone separator 2.

At the connection to the end of the curved portion 14, the introduction portion 16 is provided with a shape deformation portion 18 which is gradually deformed in cross section from the cylindrical form of the curved portion 14 to the rectangular form of the introduction portion 16.

Operations of the embodiment shown in FIGS. 3 and 4 will be described.

The combustion gas 4 including the circulation medium blown up in the riser 1 at a required superficial velocity is guided along the curved portion 14 with the cross-sectional area A equal to that of the riser 1 toward the cyclone separator 2 and is introduced into the introduction portion 16 of the lateral duct 15 with the cross-sectional area A' equal to that of the riser 1. The combustion gas is then throttled in flow cross-sectional area and enhanced in flow velocity by the throttled portion 17 into the cyclone separator 2 where it is separated into the circulation medium 5 and the exhaust gas 6.

In this case, the combustion gas 4 including the circulation medium 5 and rising through the riser 1 is smoothly guided along the curved portion 14 to the introduction portion 16 with the cross-sectional area A' equal to that of the riser 1 and moreover the circulation medium once introduced into the introduction portion 16 is guided into and captured by the cyclone separator 2 without dropping into the riser 1, so that an amount of the circulation medium taken out from the riser 1 into the cyclone separator 2 can be substantially increased in comparison with the prior art. Thus, a circulated amount of the circulation medium 5 from the riser 1 to the fluidized bed gasification furnace 7 (see FIG. 1) can be substantially increased.

The combustion gas 4 introduced to the introduction portion 16 is guided into the cyclone separator 2 with its flow velocity being enhanced by the throttled portion 17, so that the circulation medium 5 can be favorably captured by the cyclone separator 2.

Figure 5:
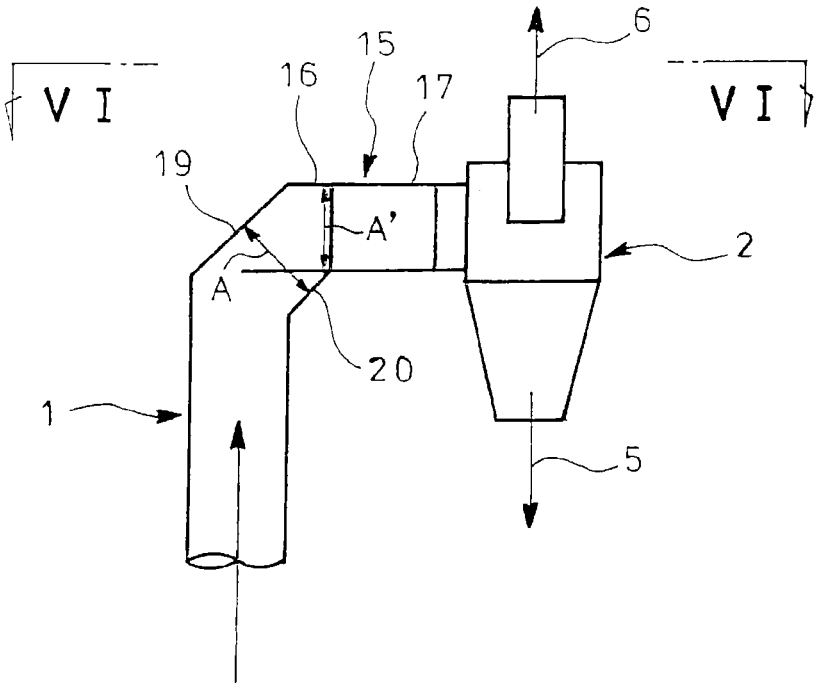
FIG. 5 is a plan view showing a further embodiment of the invention.
Figure 6:
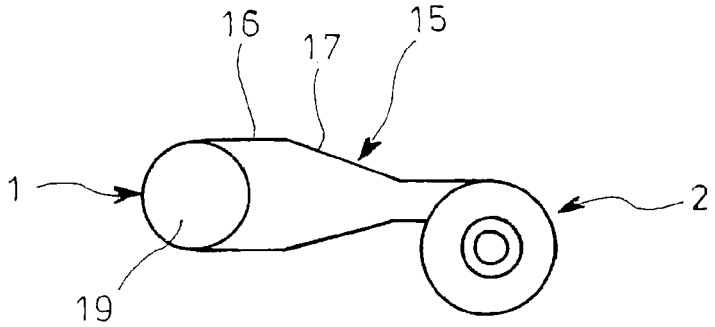
FIG. 6 is a plan view looking in a direction of arrows VI in FIG. 5.

FIG. 5 is a front view showing a further embodiment of the invention, and FIG. 6 is a front view looking in the direction of arrows VI in FIG. 5. In FIGS. 5 and 6, an upper end of a riser 1 is cut out at a position away from a connection side thereof to an introduction portion 16 of a lateral duct 15 (at an outside position of an L-shaped connection on the upper end of the riser 1 to the introduction portion 16 of the lateral duct 15) at about 45' angle and is closed with an oval slant wall 19. And, just like the above, the introduction portion 16 of the lateral duct 15 with a cross-sectional area A' equal to a cross-sectional area A of the riser 1 is connected to the upper end of the riser 1 close to the cyclone separator 2, and an end of a throttled portion 17 is connected to the cyclone separator 2. In order to prevent the connection of the upper end of the riser 1 with the introduction portion 16 from being reduced in cross-sectional area due to the slant wall 19, a bottom of the introduction portion (an inward of the L-shaped connection) is formed with a slant connection 20 which is slanting substantially in parallel with the slant wall 19 and is connected with the riser 1. Thus, cross-sectional area A of the riser 1 and the connection between the riser 1 and the introduction portion 16 is equal to the cross-sectional area A' of the introduction portion 16.

In the embodiment of FIGS. 5 and 6, the combustion gas 4 including the circulating medium 5 and rising through the riser 1 is smoothly guided into the introduction portion 16 through a connection between the riser 1 with the slant wall 19 and the introduction portion 16. Moreover, the circulation medium once introduced into the introduction portion 16 is introduced into and captured by the cyclone separator 2 without dropping into the riser 1, so that just like the above-mentioned embodiments, an amount of the circulation medium taken out from the riser 1 into the cyclone separator 2 can be substantially increased in comparison with the prior art, and thus an amount of the circulation gas 5 circulated from the riser 1 to the fluidized bed gasification furnace 7 (see FIG. 1) can be substantially increased. In the embodiment of FIGS. 5 and 6, the riser 1 is merely slantwise cut out at its upper end to provide a slant wall 19, with an advantageous effect that less change in shape of the riser 1 suffices.

Figure 7:
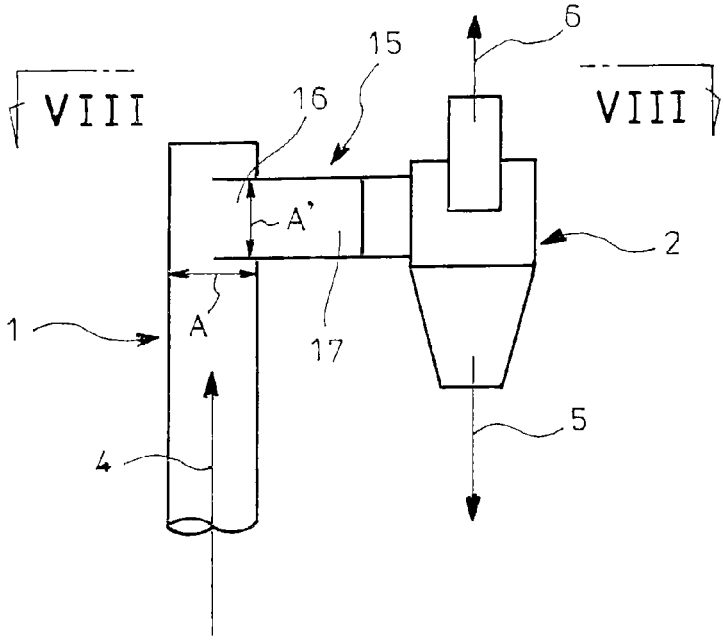
FIG. 7 is a front view showing a still further embodiment of the invention.
Figure 8:
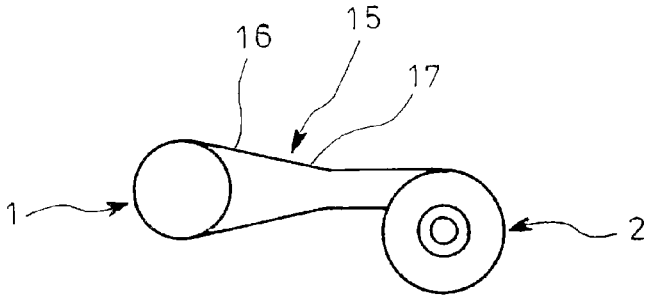
FIG. 8 is a plan view looking in a direction of arrows VIII in FIG. 7.

FIG. 7 is a front view showing a still further embodiment of the invention, and FIG. 8 is a plan view looking in the direction of arrows VIII-VIII in FIG. 7. In FIGS. 7 and 8, a lateral duct 15 comprises an introduction portion 16 connected sideways to an upper end of the riser 1 just like the above and a throttled portion 17 connected at an end thereof to a cyclone separator 2. In this respect, just like the prior art shown in FIGS. 1 and 2, the upper end of the riser 1 is protruded upwardly of the connection with the lateral duct 15.

In the embodiment of FIGS. 7 and 8, the combustion gas 4 including the circulation medium 5 and rising up through the riser 1 tends to be easily introduced into the introduction portion 16 which has a cross-sectional area A' equal to a cross-sectional area A of the riser 1. The circulation medium once introduced to the introduction portion 16 is introduced into and captured by the cyclone separator 2 without dropping into the riser 1, so that, like the above-mentioned embodiments, an amount of the circulation medium taken out from the riser 1 into the cyclone separator 2 can be increased in comparison with the prior art and thus the circulated amount of the circulation medium 5 from the riser 1 to the fluidized bed gasification furnace 7 (see FIG. 1) can be increased. In this case, a part of the circulation medium included in the combustion gas 4 blown up through the riser 1 may collide against a top of the riser 1 to drop; however, as mentioned in the above, introduction thereof into the introduction portion 16 is enhanced so that an amount of the circulation medium taken out from the riser 1 into the cyclone separator 2 is substantially increased in comparison with the prior art. Moreover, in the embodiment of FIGS. 7 and 8, the upper end of the riser 1 requires no substantial change so that the riser 1 can be fabricated cheaply.

It is to be understood that the invention is not limited to the above embodiments and that various changes and modifications may be made without departing from the scope of the invention. For example, the invention is applicable to various types of circulating fluidized bed gasification furnaces.

INDUSTRIAL APPLICABILITY

A riser top structure for a circulating fluidized bed gasification furnace according to the invention is applicable for increase of an amount of circulation medium by increasing an amount of the circulation medium taken out from a riser.

REFERENCE SIGNS LIST

1 riser
2 cyclone separator
4 combustion gas
5 circulation medium
7 fluidized bed gasification furnace
8 raw material
9 gasifying agent
10 gasification gas
11 circulation passage
12 air
14 curved portion
15 lateral duct
16 introduction portion
17 throttled portion
19 slant wall

The invention claimed is:

1. A riser top structure for a circulating fluidized bed gasification furnace comprising:

a riser for heating circulation medium by combustion of air supplied from below;

a cyclone separator to which combustion gas taken out through a top end of the riser via a lateral duct is guided for capture of the circulation medium admixed in said combustion gas;

a fluidized bed gasification furnace to which the circulation medium captured by the cyclone separator and raw material as well as a gasifying agent are guided for gasification of the raw material to produce gasification gas;

a circulation passage for returning the circulation medium in the fluidized bed gasification furnace and ungasified unreacted char to said riser, wherein said lateral duct comprises an introduction portion directed from said top end of the riser toward the cyclone separator and having a cross-sectional area equal to that of the riser to enhance taking-out of the circulation medium from the riser, and a throttled portion provided between said introduction portion and said cyclone separator and having a rectangular cross-sectional area reduced from said introduction portion to said cyclone separator to enhance a flow velocity of the combustion gas;

a curved portion curvedly connected in between the top end of the riser and the introduction portion of the lateral duct, said curved portion having a circular cross section; and a shape deformation portion provided at a connection of the introduction portion to an end of said curved portion, said shape deformation portion deformed in cross section from a cylindrical form to a rectangular form.

2. The riser top structure as claimed in claim 1, wherein the introduction portion with rectangular cross section has a flat bottom.

3. The riser top structure as claimed in claim 1, wherein the riser has a circular cross sectional shape of constant diameter.

* * * * *